US008430435B2

(12) United States Patent
Juga et al.

(10) Patent No.: US 8,430,435 B2
(45) Date of Patent: Apr. 30, 2013

(54) SLAM LATCH AND METHOD FOR THE ASSEMBLY THEREOF

(75) Inventors: Douglas L. Juga, Pleasant Prairie, WI (US); Charles E. Bullock, Waukegan, IL (US)

(73) Assignee: A.L. Hansen Manufacturing Co., Waukegan, IL (US)

( * ) Notice: Subject to any disclaimer, the term of this patent is extended or adjusted under 35 U.S.C. 154(b) by 199 days.

(21) Appl. No.: 12/725,785

(22) Filed: Mar. 17, 2010

(65) Prior Publication Data

US 2010/0237636 A1 Sep. 23, 2010

Related U.S. Application Data

(60) Provisional application No. 61/210,504, filed on Mar. 19, 2009.

(51) Int. Cl.
*E05B 15/02* (2006.01)
*E05B 15/00* (2006.01)

(52) U.S. Cl.
USPC ..... 292/341; 292/32; 292/163; 292/341.15

(58) Field of Classification Search ..... 292/3–10, 292/32, 33, 137, 163, 252, DIG. 38, 341, 292/341.15
See application file for complete search history.

(56) References Cited

U.S. PATENT DOCUMENTS 2,038,835 A * 4/1936 Frost ..... 292/16
2,178,919 A * 11/1939 Rhein ..... 292/341.15
2,180,516 A * 11/1939 Gehnrich ..... 292/341.15
2,629,156 A * 2/1953 Kamens et al. ..... 24/657
2,702,719 A * 2/1955 Greene ..... 292/16
3,909,052 A 9/1975 James
4,969,916 A * 11/1990 Weinerman et al. ..... 70/208
5,216,906 A * 6/1993 Kurrasch ..... 70/103
5,689,980 A * 11/1997 Weinerman et al. ..... 70/208
6,050,618 A 4/2000 Tieu
6,068,308 A * 5/2000 Molzer ..... 292/336.3
6,145,352 A 11/2000 Vickers et al.

(Continued)

FOREIGN PATENT DOCUMENTS

WO WO 92/02703 A1 2/1992

OTHER PUBLICATIONS

A.L. Hansen Manufacturing Co., Latch Part No. 243530, parts corresponding to drawing available prior to Mar. 19, 2008.

(Continued)

*Primary Examiner* — Carlos Lugo
(74) *Attorney, Agent, or Firm* — Brinks Hofer Gilson & Lione

(57) ABSTRACT

A slam latch includes a housing and a pair of slide latch components biased toward a strike channel by springs. Each of the slide latch components is independently slideable in a track between a locking position, wherein the slide latch components extend into the strike channel, and a strike receiving position, wherein the slide latch components are slideably moved away from the strike channel into the tracks against the biasing force of the springs. A modular latch kit provides for one of the latch components to be replaced with a plug so as to block any opening on that side of the strike channel. A method of assembling a latch includes selecting either a combination of a latch component and a spring, or a plug, and disposing the selected combination or the plug in the housing.

14 Claims, 4 Drawing Sheets

U.S. PATENT DOCUMENTS

| | | | | |
|---|---|---|---|---|
| 6,151,754 | A * | 11/2000 | Chen | 16/85 |
| 7,083,205 | B2 | 8/2006 | Hall | |
| 7,111,360 | B1 * | 9/2006 | Hsu | 16/85 |
| 7,159,910 | B2 * | 1/2007 | Hwang | 292/341.15 |
| 7,264,284 | B2 * | 9/2007 | Hsu | 292/252 |
| 7,338,097 | B2 | 3/2008 | Marzolf et al. | |
| 7,454,933 | B1 * | 11/2008 | Paige et al. | 70/208 |
| 7,950,702 | B1 * | 5/2011 | Adams | 292/1 |
| 2006/0214437 | A1 * | 9/2006 | Farzan | 292/340 |
| 2009/0315339 | A1 * | 12/2009 | Highfield | 292/2 |

OTHER PUBLICATIONS

A.L. Hansen Manufacturing Co., Latch Part No. 243690, parts corresponding to drawing available prior to Mar. 19, 2008.

Eberhard, Slam Latches—563 series, Eberhard Hardware Manufacturing Company, Strongville, Ohio, 1 page.

Eberhard, Slam Latches—561 series, Eberhard Hardware Manufacturing Company, Strongville, Ohio, 1 page.

A.L. Hansen Manufacturing Co., Latch Part No. S421XXRXEMXX, parts corresponding to drawing available prior to Mar. 19, 2008.

Al. Hansen Manufacturing Co., Latch Part No. 243530, parts corresponding to drawing available prior to Mar. 19, 2008.

Al. Hansen Manufacturing Co., Latch Part No. 243690, parts corresponding to drawing available prior to Mar. 19, 2008.

Eberhard, Slam Latches—563 series, Eberhard Hardware Manufacturing Company, Strongville, Ohio, 1 page, at least by Dec. 23, 2008.

Eberhard, Slam Latches—561 series, Eberhard Hardware Manufacturing Company, Strongville, Ohio, 1 page, at least by Dec. 23, 2008.

* cited by examiner

SLAM LATCH AND METHOD FOR THE ASSEMBLY THEREOF

This application claims the benefit of U.S. Provisional Application No. 61/210,504, filed Mar. 19, 2009, the entire disclosure of which is hereby incorporated herein by reference.

FIELD OF THE INVENTION

The present invention relates generally to a slam latch, and in particular, to a double slide slam latch, a modular slam latch and a method of assembling a slam latch.

BACKGROUND

Slam latches are typically configured as one-way latches, meaning they are configured to capture a strike component, such as a bolt, by allowing it to pass into a strike channel, but which do not allow the opposite movement of the strike component out of the strike channel. Rather, the strike component must be withdrawn laterally. In this way, the slam latches work automatically and do not require any actuation or other intervention to "reset" the latch for subsequent engagements. In other types of slam latches, the latch is configured with an actuator that moves the latch to release position.

Typically, slam latches are configured with a single latch component that extends into the strike channel from one side thereof. As such, the latch is limited as to the size of the strike component it can effectively latch, since the strength of the latch may be compromised if the strike component is too small. In addition, when engaged, the forces applied by the strike component, and resultant stresses introduced to the latch, are concentrated on one side of the latch. As such, slam latches are typically made of metal, which can increase the expense thereof, and lead to noise pollution caused by the rattling of the strike component against the latch when engaged.

It also is known to provide latches with dual rotary components that latch or engage in response to the movement of a strike component. Such latches, however, must be reset for subsequent engagements, even if the strike member is withdrawn laterally.

Ordinarily, slam latches are configured to receive a particular type of fastener, whether it is a rivet, screw or bolt, for securing the latch to a support body. Typically, however, the latches are individually configured to receive a particular size and type of fastener. As such, inventories of differently configured latches must be maintained.

SUMMARY

The present invention is defined by the following claims, and nothing in this section should be considered to be a limitation on those claims.

In one aspect, one embodiment of a slam latch includes a housing having a strike channel shaped to receive a strike component, and a pair of tracks opening into opposite sides of said strike channel. A pair of springs and a pair of slide latch components are disposed in the tracks respectively, with the slide latch components biased toward the strike channel by the springs. Each of the slide latch components is independently slideable in a corresponding one of the tracks between a locking position, wherein the slide latch components extend into the strike channel, and a strike receiving position, wherein the slide latch components are slideably moved away from the strike channel into the tracks against the biasing force of the springs.

In another aspect, a modular slam latch kit includes a housing having a strike channel shaped to receive a strike component, and a pair of tracks opening into opposite sides of the strike channel. Each of a plurality of springs is adapted to be disposed in at least one of the tracks respectively. Each of a plurality of slide latch components is adapted to be disposed in at least one of the tracks respectively such that the slide latch component is biased toward the strike channel by one of the springs. At least one plug is adapted to be disposed in at least one of the tracks such that track no longer opens into the strike channel.

In yet another aspect, a latch includes a housing having a strike channel shaped to receive a strike component, and a pair of openings opening into opposite sides of the strike channel. A spring and a latch component are disposed in the housing on one side of the strike channel, with the spring biasing the latch component toward the strike channel. A plug is disposed in the other of the openings such that the track no longer opens into the strike channel.

In yet another aspect, a modular latch assembly includes a housing having a pair of opposite outer walls and at least one polygonal shaped interior receptacle. The housing has an opening communicating with the interior receptacle through at least one of the outer walls. A latch component is moveably disposed in the housing. A polygonal shaped fastener component is disposed in the interior receptacle, such that the fastener component is non-rotatably interfaced with the interior receptacle.

In yet another aspect, a method of assembling a slam latch includes selecting a first combination of one latch component and one spring and disposing the first combination in one of the tracks of the housing. The method further includes selecting one of a second combination of another latch component and spring, or a plug, and disposing the selected one of the second combination or the plug in the other of the tracks of the housing.

The various embodiments of the slam latch, and methods of assembling the slam latch, provide significant advantages over other slam latches. For example and without limitation, a smaller strike component can be safely engaged by the dual slam latch, since the opening between the opposing latch components is smaller than the opening formed between an single latch component and an opposing side wall of the strike channel. In addition, the forces applied by the strike component are taken up by the pair of latch components, which equalizes the stresses in the latch components and housing. This additional strength can lead to the housing and other components being made of non-metallic materials, such as injection molded plastics.

The modularity of the slam latch also provides significant advantages. In particular, a single housing can be configured as either a single slam latch or as a double slam latch, simply by replacing one of the latch components with a plug. This modularity is applicable to any type of latch having more than one latch component, wherein one of the latch components can be replaced by a plug, and is not limited to slam latches. The plug can be made of a non-metallic material, such as a resilient material, that helps to cushion the strike component and reduces some metal-to-metal contact and the resultant noise pollution. A similar non-metallic lining can be applied to the surface of the strike channel to further cushion the strike component and reduce noise pollution. The slam latch housing is also configured to accommodate different fastener components, which reduces the number and type of housings that must be manufactured and inventoried.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
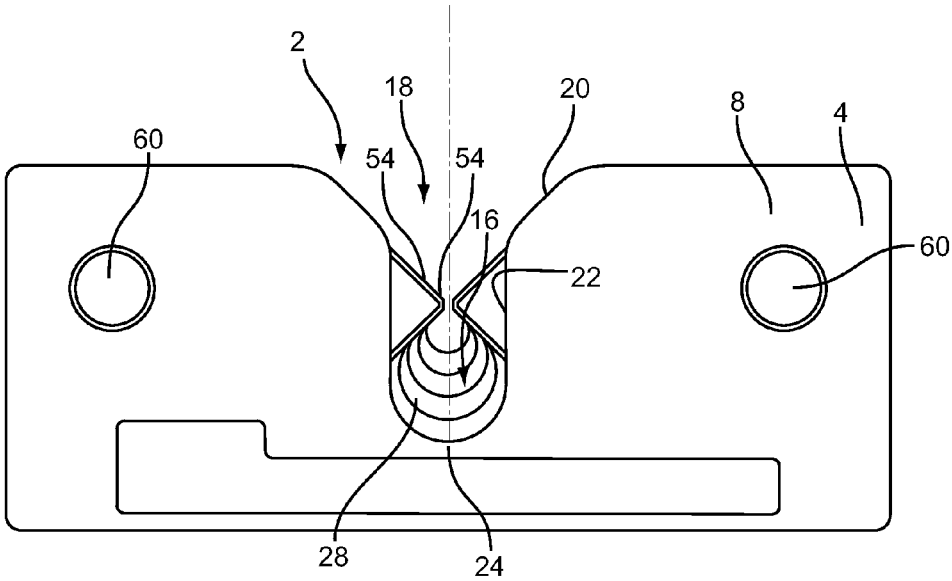
FIG. 1 is an elevated view of a double slam latch.
Figure 2:
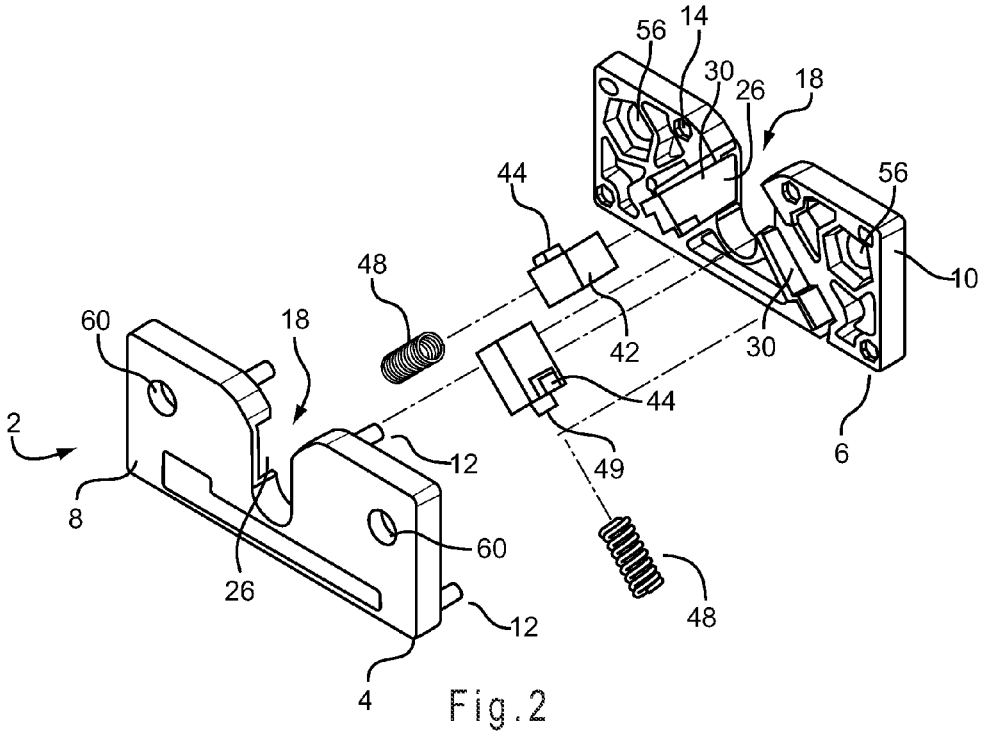
FIG. 2 is an exploded perspective view of the double slam latch shown in FIG. 1 without an internal fastener component.
Figure 3:
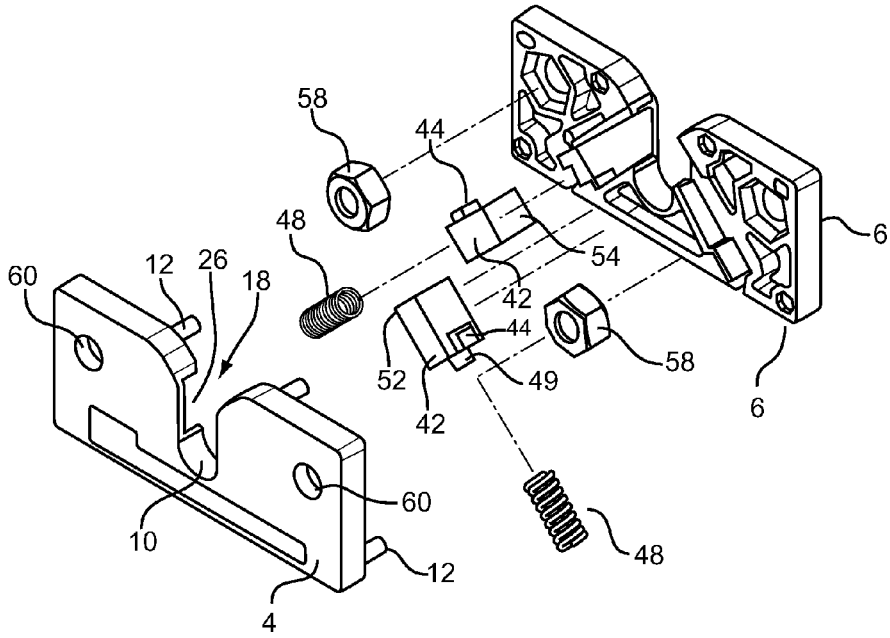
FIG. 3 is an exploded perspective view of the double slam latch shown in FIG. 1 with a pair of internal fastener components.
Figure 4:
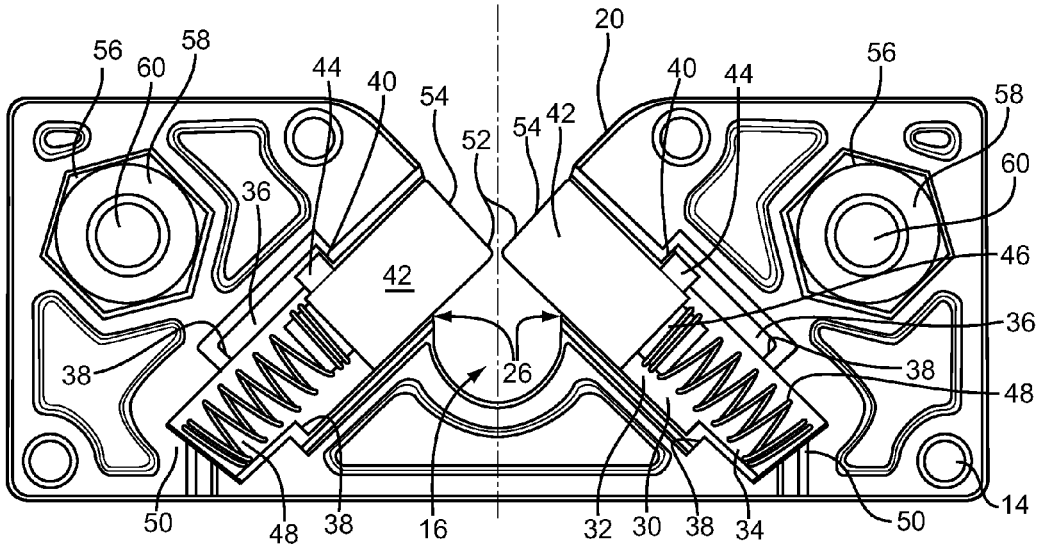
FIG. 4 is an interior elevated view of the double slam latch shown in FIG. 3.
Figure 5:
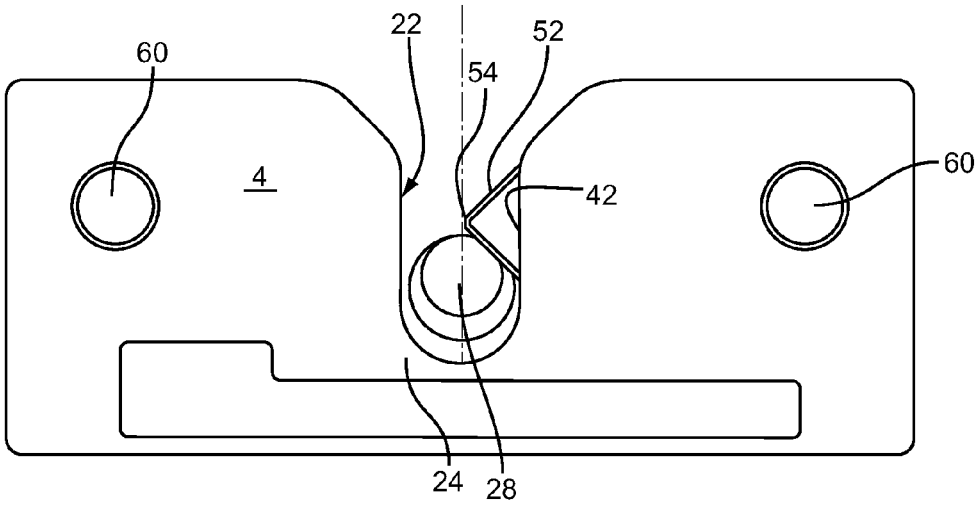
FIG. 5 is an elevated view of a single slam latch with a plug.
Figure 6:
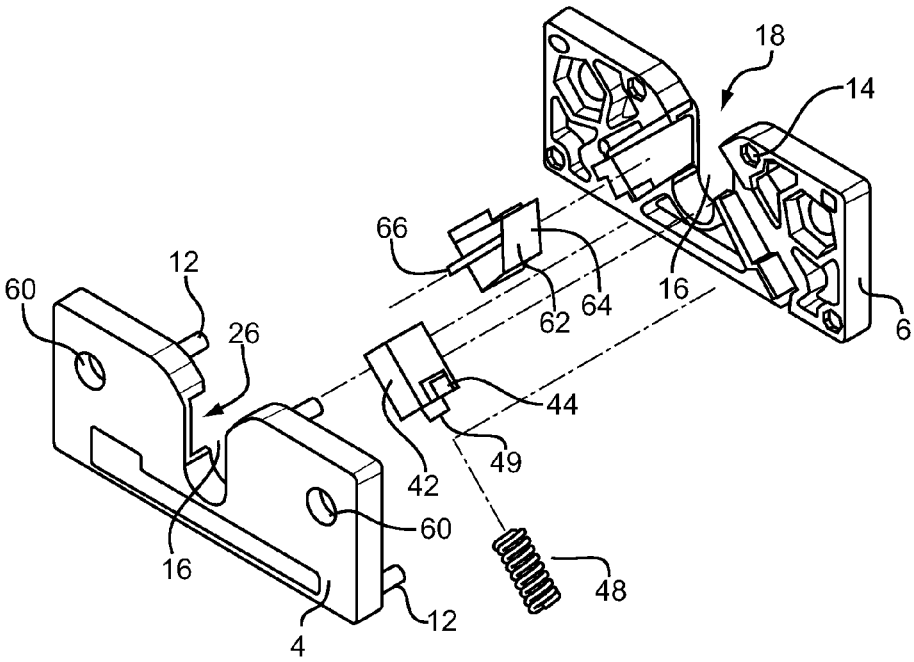
FIG. 6 is an exploded perspective view of the single slam latch shown in FIG. 5 without an internal fastener component.
Figure 7:
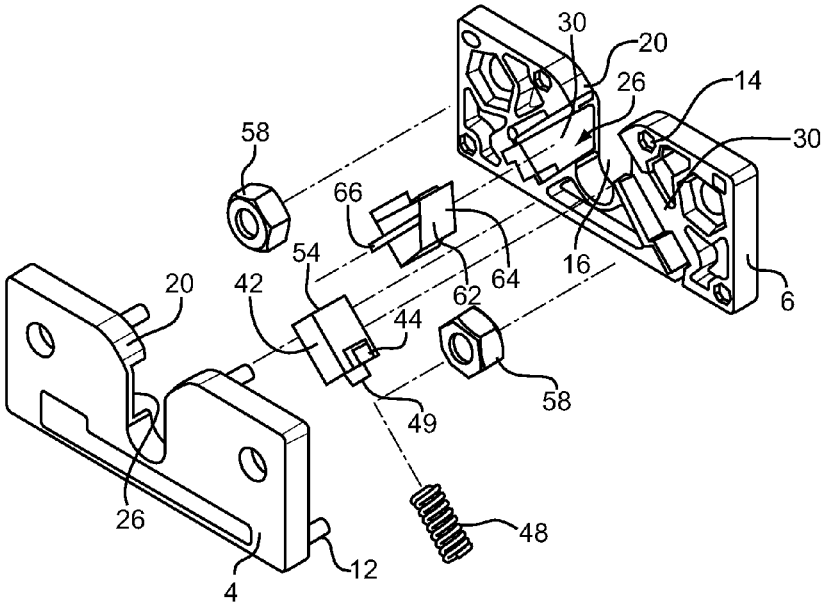
FIG. 7 is an exploded perspective view of the single slam latch shown in FIG. 5 with a pair of internal fastener components.

It should be understood that the term "plurality," as used herein, means two or more. The term "longitudinal," as used herein means of or relating to length or the lengthwise direction. The term "lateral," as used herein, means situated on, directed toward or running from side to side. The term "coupled" means connected to or engaged with whether directly or indirectly, for example with an intervening member, and does not require the engagement to be fixed or permanent, although it may be fixed or permanent, and includes both mechanical and electrical connection.

Referring to FIGS. 1-4, a first embodiment of a slam latch is shown as having a housing 2, otherwise referred to as a casing, formed from a pair of opposite housing components 4, 6. The housing components, each having an outer wall with an outer surface 8, 10, are coupled together by way of mechanical fasteners, snap-fit, welding, adhesives, or other known types of fasteners. One of the housing components has a plurality of posts 12 that are received in openings 14 formed in the other of the housing components. The post/opening interface secures the housing components against relative rotation and shearing. In one embodiment the housing components are made of steel, e.g. cast or forged, although it should be understood that they can be made of various types of metal such as zinc die casting, or from various plastics, such as injection molded plastic. When coupled together, the housing defines a strike channel 16 open to one side of the housing. A mouth 18 of the channel 16 includes curved and/or tapered shoulder portions 20 at the entry of the strike channel. The housing further defines side surfaces 22 and a bottom surface 24 of the strike channel, which has a substantially U-shaped profile. A pair of openings 26 is formed and opens into opposites sides of the strike channel 16.

In one embodiment, the strike channel is shaped and dimensioned to receive a strike component 28, such as a bolt or rod. In one embodiment, the strike channel may be dimensioned to receive a strike component having diameters including and between about ⅛ inches (3.2 mm) to ⅜ inches (9.5 mm), including rods having a diameter of ⅛ inches (3.2 mm), 3/16 inches (4.8 mm), ¼ inches (6.4 mm), 5/16 inches (7.9 mm) and ⅜ inches (9.5 mm), although it should be understood that the strike channel can be sized and dimensioned to receive and accommodate smaller and larger strike components. For example in one embodiment, the strike channel may have width of 0.39 inches. It should also be understood that the strike component can have a circular cross-section, or non-circular cross section.

The housing components 4, 6 form and define various interior cavities therebetween. In one embodiment, the housing components may form a pair of tracks 30 that open into the strike channel through the openings 26. The tracks are preferably formed at an angle relative to the side wall surface 22 or a centerline 32 extending parallel thereto, for example between 0 degrees and 90 degrees, and preferably between about 30 degrees and 60 degrees, and in one embodiment may be about 45 degrees. The tracks include a primary latch receiving track 32, a secondary spring track 34 extending from the bottom of the primary track and an auxiliary stop track or channel 36 disposed along one side of the primary track. The bottom of the primary and auxiliary tracks define a shoulder or stop 38, while the top of the auxiliary track or channel defines another shoulder or stop 40, with the stops defining a range of motion for a slide latch member sliding along the primary track 32.

The slide latch component 42 is disposed in the primary track 32. The slide latch component includes a stop portion 44 extending from one side thereof. The stop portion 44 is disposed in the auxiliary track 36. In operation, the bottom 46 of the latch component and stop portion 44 abuts or engages the bottom shoulder 38 when the latch component is moved or slid to a strike receiving position against the force of a spring 48, which may be a compression spring, and which is disposed in the spring track 34. Other springs, including tension springs, torsion springs, cantilevered springs etc. may also be suitable for biasing the latch component to a locking position. The spring 48 acts between the bottom 46 of the latch component, and is located on a post 49 extending therefrom, and the bottom of the spring track 50. The spring biases the latch component towards a locking position. The stop portion 44 engages the upper shoulder 40 when the latch component is moved to the locking position.

As shown in FIGS. 1-4, the slam latch is provided with opposite pairs of tracks 30, slide latch members 42 and springs 48. When in the fully extended locking position, the outermost corners 52 of the latch components extend substantially to a centerline 32 of the strike channel 16. The upper face 54 of the latch components are angled relative to the centerline 32, such that when engaged by a strike component 28, the latch members 42 are pushed downwardly in the tracks 30 against the force of the springs 48. Although the main body portion of the latch component is shown as having a rectangular shape, other shapes may also be suitable, depending on the angular orientation of the latch component, the configuration of the strike member, and other such parameters. Because a pair of opposing slide latch members 30 is provided, the latch can accommodate a greater number of different sized strike components than does a single latch system. With a single latch member, the strike component is necessarily configured with a diameter, or other width parameter, at least slightly larger than ½ of the width of the strike channel, or at least slightly larger than the distance between the outermost corner 52 of the latch component and the opposite side wall of the strike channel 22. Therefore, a smaller strike component can be safely engaged by the dual slam latch, since the opening between the opposing latch components is smaller than the opening formed between an single latch component and an opposing side wall of the strike channel. In addition, the forces applied by the strike component 28 are taken up by the pair of latch components, which equalizes the stresses in the latch components and housing. This additional strength may also permit the housing and other components being made of non-metallic materials, such as injection molded plastics.

The housing components further define in one embodiment at least one interior fastener receptacle 56 or socket. For example, a pair of receptacles are shown, although it should be understood that a single receptacle or more than two may also be suitable. The receptacle has a polygonal shape, for example a hex shape, which is sized and configured to non-rotatably receive a fastener component, such as a nut 58. An opening 60 extends through the outer wall of the housing component and communicates with the fastener receptacle 56, for example to allow a fastener to extend through the opening and threadably engage a fastener component 58, such as a nut, disposed in the receptacle. For example, in one embodiment, the receptacle is shaped to received a ¼-20 hex nut. In addition, various lock nuts can installed in the receptacle. In this way, the housing does not have to be tapped, and the housing may be made of plastic. Of course, the housing can be configured without such receptacles, with smooth through-holes or tapped holes formed therein, or simply with the fastener component omitted from the receptacle. The receptacle sizes can be varied. In another embodiment, hex nuts having the same hex interface but with different threaded openings are also provided. In yet another embodiment, a fastener insert has a fixed external, polygonal shape configured to non-rotatably mate with the receptacle 56, and an interior shape with a polygonal socket (e.g., hex shaped) or auxiliary receptacle shaped to receive a smaller sized nut. In this way, variously configured fastener inserts can be used with a single housing to accommodate different size fastener components. In the embodiments of FIGS. 1 and 2, and 5 and 6, the fastener components are omitted, while in the embodiment of FIGS. 3 and 4, and 7 and 8, the fastener components are included for installation.

Now referring to the embodiments of FIGS. 5-8, one of the slide latch components may be removed so as to form a single slam latch. This type of latch is configured to engage and receive a strike component 28 having a rod with a diameter including and between ¼ inches (6.4 mm) to ⅜ inches (9.5 mm), although it should be understood that the strike channel and travel of the latch component can be varied to accommodate strike components having greater or lesser dimensions. The latch component, spring and housing components for this embodiment are the same as those described above with respect to the double slam latch, and with the same reference numbers being used in the drawings.

Figure 8:
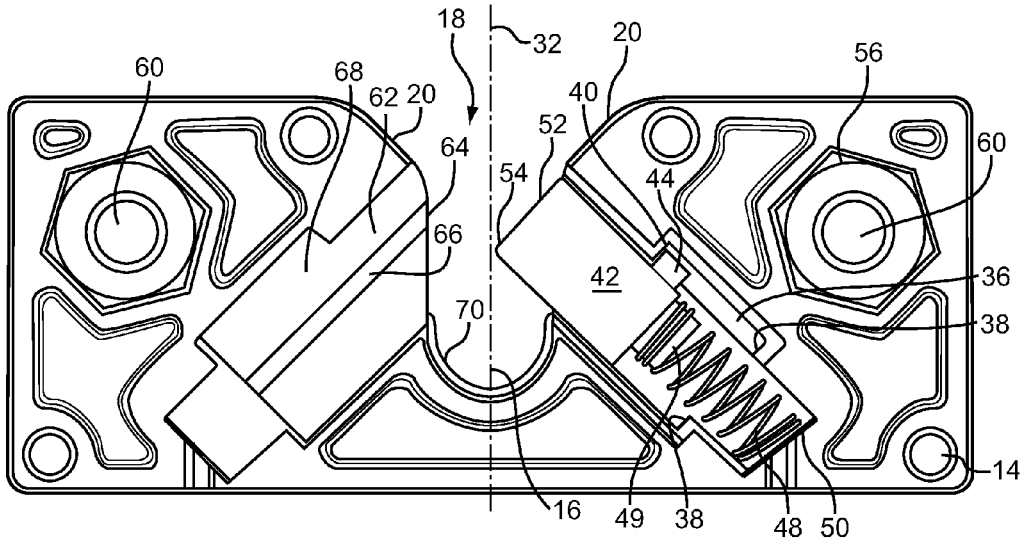
FIG. 8 is an interior elevated view of the double slam latch shown in FIG. 6.

In this embodiment, a plug or insert 62 is disposed in one of the tracks 30, 32, 36 and openings 26 in the housing opposite a single, slide latch component 42. The plug 62 has a face member 64 that follows the contour of the side wall surface 22 of the strike channel, and a body portion that has a contour mating with and substantially filling the primary and auxiliary tracks 32, 36. In this way, the plugged track, and the opening thereof to the strike channel, no longer opens into the side of the strike channel. A shoulder portion 68 engages the shoulder of the auxiliary track so as to prevent the plug 62 from being removed from the track. The plug 62 has a pair of ribs 66 extending toward the housing components that provide for tolerance buildup, but maintain a tight fit of the plug between the housing components. The plug 62 is preferably made of a non-metallic, resilient material, such as rubber, plastic or various elastomeric materials, which helps to cushion the strike component and reduces some metal-to-metal contact and the resultant noise pollution. In other embodiments, the plug may be made of metal, wood or any other suitable material. As shown in FIG. 8, a similar non-metallic lining 70 can be applied to the surface of the strike channel, for example the sides or bottom, to further cushion the strike component and reduce noise pollution. The lining 70 can be overmolded, or secured by adhesives, fasteners, snap-fit, etc. It should be understood that the plug 62 or insert, as well as the liner 70, can be incorporated into any latch assembly wherein two latch components are used to secured a strike component, or where a strike channel or other surface can create a metal-to-metal contact, and such aspects are not limited to the slam latch disclosed herein.

The modularity of the latch provides significant advantages. In particular, a single housing 2 can be configured with either a single latch component, including for example and without limitation a single slam latch component, or with a double latch component, including for example and without limitation a double slam latch, simply by replacing one of the latch components 42 with a plug 62. This modularity is applicable to any type of latch having more than one latch component, wherein one of the latch components can be replaced by a plug, and is not limited to slam latches.

In one embodiment, a modular latch kit system includes a plurality of housings 2 having a strike channel 16 shaped to receive a strike component 28. A plurality of springs 48, a plurality of latch components 42 and a plurality of plugs 62 are also provided. A latch kit may also include at least one housing 2, at least a pair of latch components 42, at least a pair of springs 48 and at least one plug 62. In either embodiment, the operator determines what type of latch to assemble, and then selects the components accordingly. For example, for a double slam latch, the operator selects a housing 2, a pair of latch components 42 and a pair of springs 48. In addition, the operator may also determine whether a fastener component 58 is to be installed in the housing. The components are then positioned in one of the housing components 4, with the other housing component 6 then being secured to the first housing component to complete the assembly.

If the operator desires to assemble a single latch system, the operator selects a housing 2, a single latch component 42, a plug 62 and a single spring 48. In addition, the operator may also determine whether a fastener component 58 is to be installed in the housing. The components are then positioned in one of the housing components 4, with the other housing component 6 then being secured to the first housing component to complete the assembly.

The modular fastener receptacle may provide for the housing to be easily configured as a "threaded" housing, which is adapted for receiving a threaded fasteners, or as through-hole housing, through which a fastener extends without threadable engagement, simply by providing for a fastener component 58 to be received in the housing. In this way, a single housing can be used for different applications, without the attendant increase in inventory and tooling costs.

In operation, the user installs a latch, for example and without limitation by securing the latch to a support body. The user then moves a latchable body having a strike component 28 toward the latch until the strike component enters the mouth 18 of the strike channel and applies a force to the end faces 54 of the latch components, thereby pushing them downwardly in the tracks 32 against the force of the corresponding springs 48, which are compressed in the spring track 34. Eventually, the latch components 42, and in particular the corners 54 thereof, are separated a sufficient amount to permit the strike member 28 to pass therebetween, wherein-after the strike component 28 is received in the strike channel 16 below the latch components and the latch components 42 are biased by the spring 48 to a locking position. In this embodiment of a slam latch, the latch components are not locked or otherwise secured in the strike receiving position. Rather, they are simply moved to that position by the force of the strike member. Likewise, in this embodiment, the latch components are not actuated independently of the strike member. Rather, the strike member must be removed from the latch strike channel by way of a lateral withdrawal (substantially perpendicular to the outer surface of the latch housing wall). The strike component 28 is prevented from being moved out of the strike channel 16 through the mouth thereof by the latch components 42. The single latch component works in the same way, with the latch members being forced to a strike receiving position, and then being biased back to a locking position once the strike component passes beneath the latch component.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A modular slam latch kit comprising:

at least one housing having a strike channel shaped to receive a strike component, a polygonal shaped interior receptacle and a pair of tracks opening into opposite sides of said strike channel;

a pair of springs, wherein each of said pair of springs is adapted to be disposed in at least one of said tracks respectively;

a pair of slide latch components, wherein each of said pair of slide latch components is adapted to be disposed in at least one of said tracks respectively such that said slide latch component is biased toward said strike channel by one of said springs;

a polygonal shaped fastener component shaped to be received in said polygonal shaped interior receptacle, wherein said polygonal shaped interior receptacle is configured to constrain a rotation of said polygonal shaped fastener component; and a plug adapted to be disposed in at least one of said tracks in place of one of said spring members and slide latch components such that said at least one of said tracks no longer opens into one of said opposite sides of said strike channel.

2. The modular slam latch kit of claim 1 wherein said plug comprises a non-metallic material.

3. The modular slam latch kit of claim 1 further comprising at least one liner adapted to be disposed on a bottom of said strike channel, wherein said liner comprises a non-metallic material.

4. The modular slam latch kit of claim 1 wherein said at least one polygonal shaped fastener component comprises a hex nut.

5. The modular clam latch kit of claim 1 wherein said at least one polygonal shaped fastener component comprises a plurality of first polygonal shaped fastener components and a plurality of second polygonal shaped fastener components, wherein said plurality of said first polygonal shaped fastener components are different than said plurality of said second polygonal shaped fastener components.

6. A latch comprising:

a housing having a strike channel shaped to receive a strike component, a polygonal shaped interior receptacle and a pair of openings opening into opposite sides of said strike channel;

a spring disposed in said housing on one side of said strike channel respectively;

a latch component disposed in said housing and biased into said strike channel through one of said pair of openings by said spring;

at least one polygonal shaped fastener component shaped to be received in said polygonal shaped interior receptacle, wherein said polygonal shaped interior receptacle is configured to constrain a rotation of said polygonal shaped fastener component; and a plug disposed in the other of said pair of openings.

7. The latch of claim 6 wherein said plug comprises a non-metallic material.

8. The latch of claim 6 wherein said housing comprises a pair of tracks disposed on opposite sides of said strike channel and communicating with respective ones of said openings on opposites sides of said strike channel, and wherein said latch component comprises a slide latch component slideably disposed in one of said tracks, wherein said slide latch component is biased toward said strike channel by said spring, said slide latch component slideable in said track between a locking position, wherein said slide latch component extends into said strike channel, and a strike receiving position, wherein said slide latch component is slideably moved away from said strike channel into said track against the biasing force of said spring, and wherein said plug is disposed in said other of said pair of openings such that said other of said pair of tracks no longer opens into one of said opposite sides of said strike channel.

9. A modular latch assembly comprising:

a housing comprising a pair of opposite outer walls and at least one polygonal shaped interior receptacle, said housing having an opening communicating with said interior receptacle through at least one of said outer walls, a strike channel shaped to receive a strike component and a track opening into a side of said channel;

a latch component slideably moveable in said track, wherein said latch component is biased toward said strike channel by a spring; and a polygonal shaped fastener component disposed in said interior receptacle, wherein said interior receptacle is configured to constrain a rotation of said polygonal shaped fastener component.

10. The modular latch assembly of claim 9 wherein said housing has a pair tracks opening into opposite sides of said strike channel, and further comprising a pair of said latch components and a pair of springs, one each of said latch components and said springs disposed in each of said tracks.

11. A method of assembling a slam latch comprising:

providing at least one housing having a strike channel shaped to receive a strike component, at least one polygonal shaped interior receptacle and a pair of tracks opening into opposite sides of said strike channel;

providing a pair of springs, wherein each of said pair of springs is adapted to be disposed in at least one of said tracks respectively;

providing a pair of slide latch components, wherein each of said pair of slide latch components is adapted to be disposed in at least one of said tracks respectively such that said slide latch component is biased toward said strike channel by one of said springs;

providing a plug adapted to be disposed in at least one of said tracks such that said at least one of said tracks no longer opens into one of said opposite sides of said strike channel;

selecting a first combination of one of said slide latch components and one of said springs;

disposing said first combination in one of said tracks of said housing;

selecting one of a second combination of another of said slide latch components and another of said springs or said plug;

selecting one of a plurality of polygonal shaped fastener components and disposing said selected one of said polygonal shaped fastener components in said interior receptacle such that said interior receptacle constrains a rotation of said polygonal shaped fastener component; and disposing said selected one of said second combination or said plug in the other of said tracks of said housing.

12. The method of claim 11 wherein said housing comprises a pair of opposing case components, and further comprising connecting said opposing case components with said selected first combination and one of said selected second combination or said plug between said case components.

13. A method of assembling a slam latch comprising:

providing at least one housing comprising a pair of opposite outer walls and at least one polygonal shaped interior receptacle, said housing having an opening communicating with said interior receptacle through at least one of said outer walls, and said housing comprising a track opening into a side of a strike channel adapted to receive a strike component;

disposing a latch component and a spring in said track, wherein said latch component is slideable in said track and is biased toward said strike channel by said spring; and selecting one of a plurality of polygonal shaped fastener components and disposing said selected one of said polygonal shaped fastener components in said interior receptacle, wherein said interior receptacle is configured to constrain a rotation of said selected one of said polygonal shaped fastener components.

14. The method of claim 13 wherein said disposing said latch component in said housing comprises disposing a pair of said latch components and said spring into a pair of said tracks opening into opposite sides of said strike channel.

* * * * *